US005511280A

United States Patent [19]

Jankowski

[11] Patent Number: 5,511,280

[45] Date of Patent: Apr. 30, 1996

[54] VACUUM CLEANER ASSEMBLY WITH LOW VACUUM INLET

[76] Inventor: William C. Jankowski, P.O. Box 508, Orleans, Mass. 02653

[21] Appl. No.: 394,601

[22] Filed: Feb. 27, 1995

[51] Int. Cl.[6] ..... A47L 5/36

[52] U.S. Cl. ..... 15/327.2; 15/352; 15/353

[58] Field of Search ..... 15/327.2, 327.6, 15/352, 353, 339

[56] References Cited

U.S. PATENT DOCUMENTS 1,219,756 3/1917 Meredith-Jones ..... 15/327.6 X
2,242,278 5/1941 Yonkers ..... 15/327.6 X
2,657,416 11/1953 Smith ..... 15/353 X
3,996,641 12/1976 Eichholz ..... 15/339
5,386,613 2/1995 Woo ..... 15/353 X

*Primary Examiner*—Chris K. Moore

[57] ABSTRACT

A vacuum cleaner of the wet or dry tank type having a vacuum inlet introduced at the base of the tank and an internal conduit conducting the flow of matter from the vacuum inlet to the top of the tank and discharging matter from the top of the tank downward into the accumulation area of the tank, the entry of the vacuum inlet through the wall of the tank sealed to preserve liquid tight and air tight integrity of the wall of the tank, a flexible external vacuum hose connecting to the vacuum inlet at the base of the tank.

10 Claims, 3 Drawing Sheets

VACUUM CLEANER ASSEMBLY WITH LOW VACUUM INLET

BACKGROUND OF THE INVENTION

1. Field of the Invention

The invention relates to tank type vacuum cleaners and more particularly to the type of vacuum cleaner that is especially adapted to use in the home, in the workshop, and in industry as a wet or dry type vacuum and the primary object of the present invention is to provide an improved device of this character.

2. Description of Prior Art

The wet or dry shop vacuums presently in the marketplace characteristically consist of on open top collection tank mounted on wheels or casters and a cover or lid in which an electric motor and fan unit are mounted. The fan unit creates a suction within the tank and debris and liquid are drawn into the tank through a vacuum hose which is connected to an inlet located in the cover of the tank or to an inlet located high on the side of the tank itself. The air being drawn from the inside of the tank and through the fan is filtered to prevent dust and debris from reaching the motor and fan unit and to prevent dust and debris-laden exhaust from being expelled into the environment in which the vacuum is being operated. While filter methods vary, the most usual is a cylindrical filter of paper, cloth, or other porous material suspended from the cover of the tank and incorporating a check ball or float arrangement which cuts off suction to the fan unit should the liquid level in the tank rise to a level at which it threatens to enter the motor and fan unit itself. Caster mounts and casters located around the lower circumference of the tank give the vacuum cleaner mobility and the operator normally drags the vacuum assembly over the surface being vacuumed using the external vacuum hose as a tow line.

The advantages of the above described arrangements are apparent to anyone practiced in the art: (1) the fan and electric motor unit is relatively isolated from debris and especially from liquids coming into and being stored in the tank, (2) the arrangement readily lends itself to a filter and filter housing located below the motor and fan unit, attached to the cover, and containing a simple ball or float check valve, (3) the location of the inlet which connects to the vacuum hose in the cover of the assembly or at a point high up along the side of the tank makes it possible for a large amount of debris and liquid to accumulate in the tank before such accumulation reaches a level which would close off the vacuum inlet and (4) the location of the heavy operating machinery of the vacuum in and attached to the cover of the assembly makes for convenience and ease of emptying the tank inasmuch as the weight of the operating machinery is removed when the cover is removed.

The disadvantages of the above described arrangements are readily apparent to anyone who has ever actually used the wet or dry shop vacuums which are currently in the marketplace and fit the above description: (1) the location of the electric motor and fan unit at the top of the assembly creates a high center of gravity which results in extreme vertical instability for the entire assembly and (2) the location of the vacuum hose inlet in the cover at the top of the assembly or in the side of the tank a short distance down from the top of the tank causes the operator to exert substantial leverage on the inherently unstable assembly when the operator attempts to drag the vacuum forward using the vacuum hose as the tow line. When the casters or wheels on which the assembly is mounted encounter any debris or obstruction, or even such resistance as is offered by a thick pile carpet, and the operator attempts to pull the unit forward using the vacuum hose as a tow line, the combination of high center of gravity and substantial mechanical advantage produced by the high connection point for the vacuum hose conspire to cause the vacuum cleaner assembly to capsize.

The problem of extreme vertical instability created by the high center of gravity found in wet or dry vacuums now in the marketplace is solved in a novel and simple manner by the invention disclosed in my co-pending Application entitled "Wet or Dry Vacuum with Low Center of Gravity". The problem of substantial leverage produced by an external hose connection located high on a wet or dry vacuum assembly and the destabilizing effect of attempting to tow the assembly using the external vacuum hose as a tow line is dealt with and solved in a simple and novel manner by the present invention.

The degree of increased stability achieved by lowering the connection point for the external vacuum hose will vary from one vacuum assembly to another, depending upon the weight distribution and center of gravity of the assembly itself. The substantial decrease in mechanical advantage that comes with lowering the vacuum connection to the base of the assembly is apparent. The relationships between the parts are the relationships of the parts of a second class lever: the point on the floor at which resistance or an obstacle stops the forward motion of a caster being the fulcrum, the weight of the assembly concentrated at its center of gravity being the resisting force, and the forward pressure being applied to the external vacuum hose being the applied force. When the external vacuum hose is moved from a connection point at the top of the assembly, for example two feet above the fulcrum, to a point at the base of the assembly three or four inches from the fulcrum, the loss of mechanical advantage is such that approximately six times as much applied force is required to lift and capsize the assembly.

SUMMARY OF THE INVENTION—OBJECTS AND ADVANTAGES

The principal object of the present invention is to provide an improved vacuum cleaner assembly with the vacuum inlet located at the base of the tank.

Another object of the present invention is to provide an internal conduit which conducts debris and liquids from the vacuum inlet at the base of the tank to the top of the tank and discharges such debris and liquids in a generally downward direction into the accumulation area of the tank, eliminating the problem of accumulated debris or liquid blocking discharge of new debris or liquid entering the tank.

Another object of the invention is to introduce the vacuum inlet through the wall of the tank in a manner that ensures both air tight and liquid tight integrity of the tank and to connect the internal vacuum hose to the vacuum inlet in a manner that ensures both air tight and liquid tight integrity of the connection.

Another object of the disclosed invention is to achieve the above objects in a manner that is unique, simple, and lends itself to ease of assembly and low production cost.

The principal advantage of the disclosed invention is that it makes practical the connection of the external vacuum hose at the base of the tank and in substantially the same horizontal plane as the caster mounts attached to the lower circumference of the tank thereby enhancing the vertical stability of the vacuum cleaner assembly of which the tank is a part, making it possible for the operator of the assembly to tow the assembly by the external hose without leverage sufficient to capsize the assembly when the casters or wheels encounter resistance on the surface being vacuumed.

Further objects and advantages of the invention will become apparent from a consideration of the drawings and the ensuing description.

DETAILED DESCRIPTION OF THE PREFERRED EMBODIMENT

Figure 1:
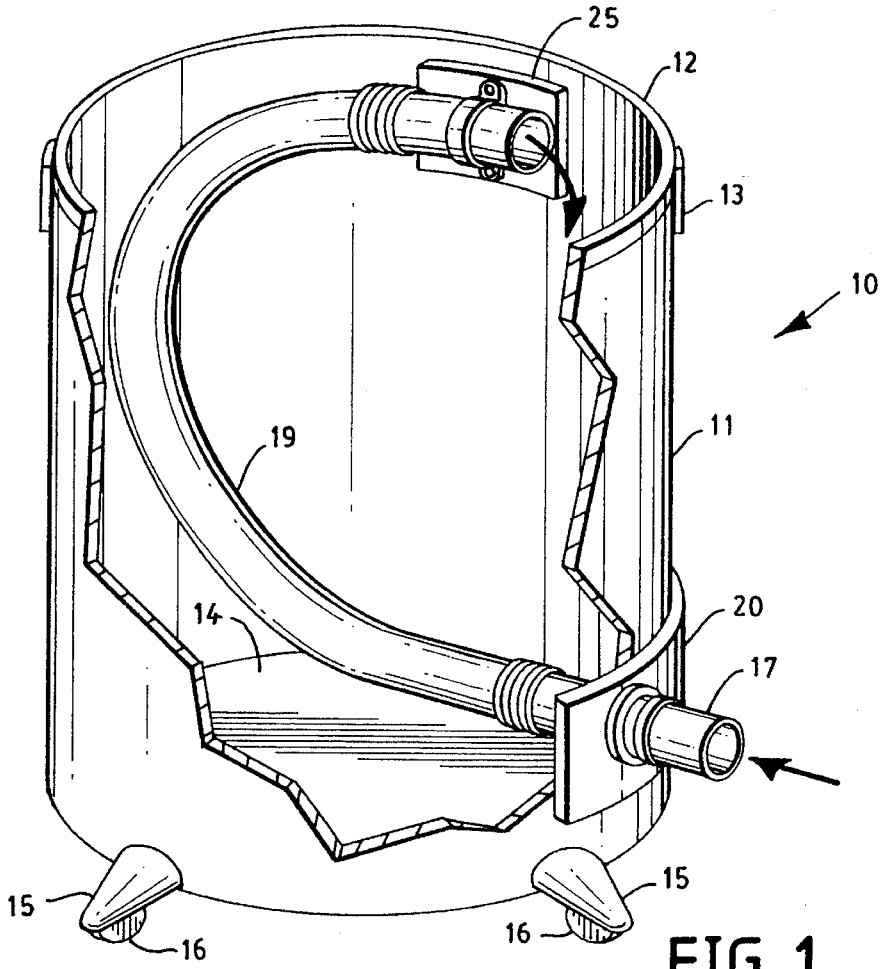
FIG. 1 is a perspective view of a vacuum cleaner tank, some of the wall of the tank being broken away to show details of construction.
Figure 2:
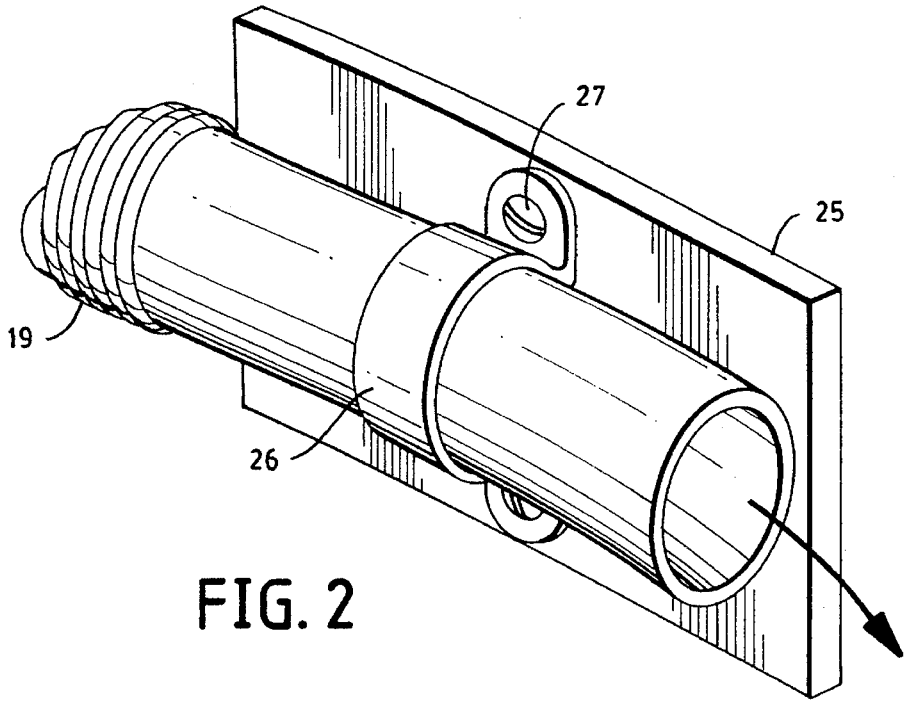
FIG. 2 is a perspective view showing details of connection of internal vacuum hose to top of tank wall.

Referring now to the accompanying drawings wherein like reference numerals denote the same parts throughout the various views, there is disclosed in FIG. 1 a vacuum cleaner tank generally designated as 10, being generally cylindrical in shape and having a vertical wall 11, a rolled upper edge 12, a plurality of releasable fasteners for connecting a removable cover (not shown) to tank 10, a base 14, and a plurality of caster mounts 15 and casters 16 attached around the lower circumference of tank 10. Tank 10 is comprised of plastic and is manufactured by molding.

Figure 3:
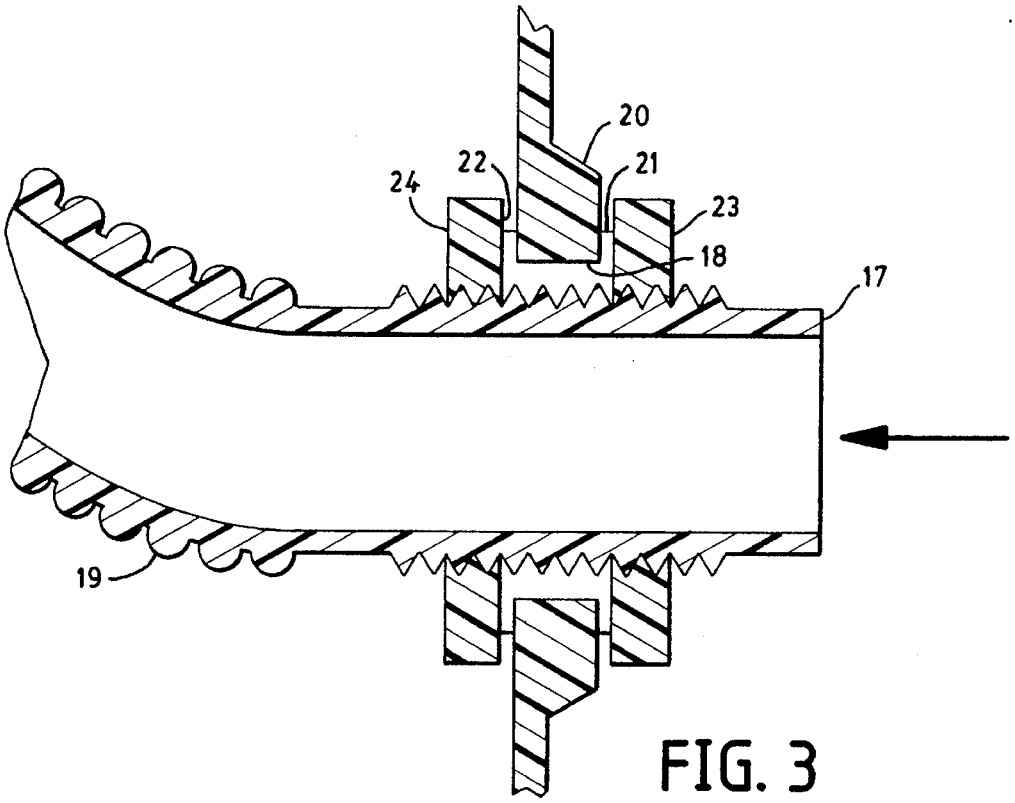
FIG. 3 is a vertical cross sectional view showing details of vacuum inlet connection as it passes through wall of tank at base of tank.
Figure 4:
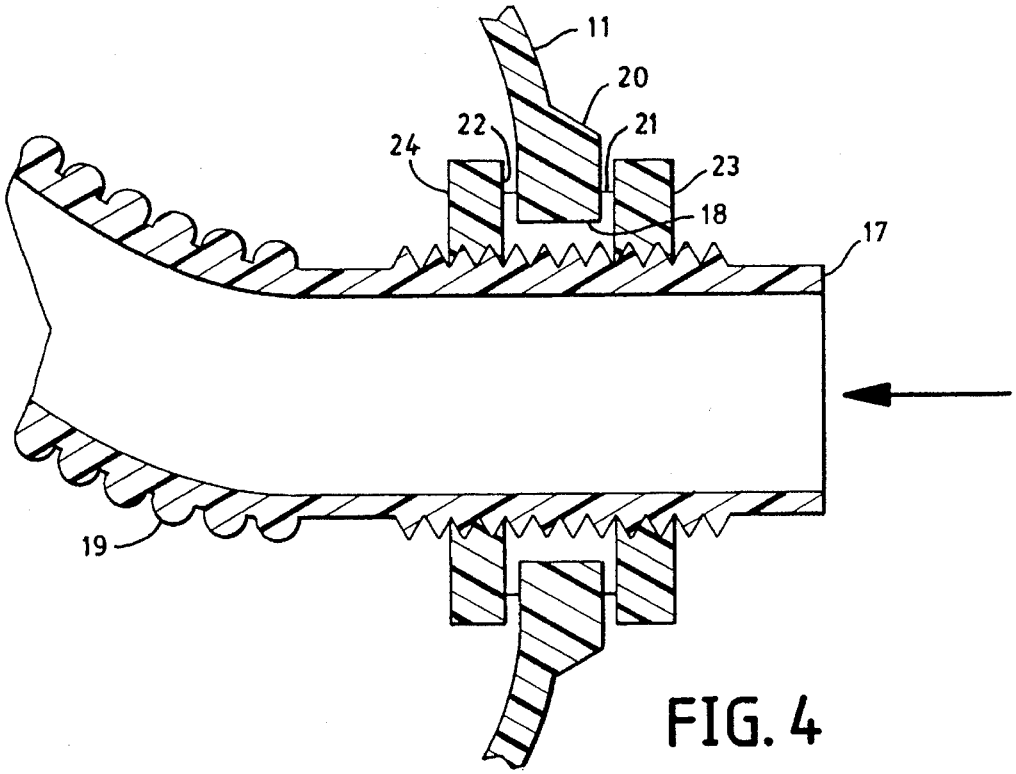
FIG. 4 is a horizontal cross sectional view showing details of vacuum inlet connection as it passes through wall of tank at base of tank.

An annular vacuum inlet 17 which is adapted to connect with a conventional external flexible vacuum hose (not shown) is introduced through an annular opening 18 in vertical wall 11. Annular vacuum inlet 17 has female threads cut for a predetermined distance around its exterior surface and is molded to and an integral part of internal vacuum hose 19 as seen in FIG. 3.

Vertical wall 11 of tank 10 is molded to an increased thickness forming plateau 20 projecting out from the external surface of vertical wall 11 a predetermined distance and surrounding annular opening 18 by a predetermined distance. The exterior face of plateau 20 follows the cylindrical curve of vertical wall 11 with the molded exterior face of plateau 20 flattened for a predetermined distance around annular opening 18 and the molded cylindrical curve of the interior face of vertical wall 11 is flattened for a predetermined distance surrounding annular opening 18, providing parallel flat surfaces against which external resilient gasket 21 and internal resilient gasket 22 mate when compressed by plastic nut 23 and plastic nut 24 forming water tight and air tight passage for vacuum inlet 17 through vertical wall 11. The thickness of vertical wall 11 is increased at the top by plateau 25 which is a molded integral part of vertical wall 11. Internal vacuum hose 19 rises in a fair curve from vacuum inlet 17 to plateau 25 where it is held by clamp 26 with the discharge opening of internal vacuum hose 19 facing in a generally downward direction. Clamp 26 is connected to plateau 25 by screw fasteners 27.

Figure 5:
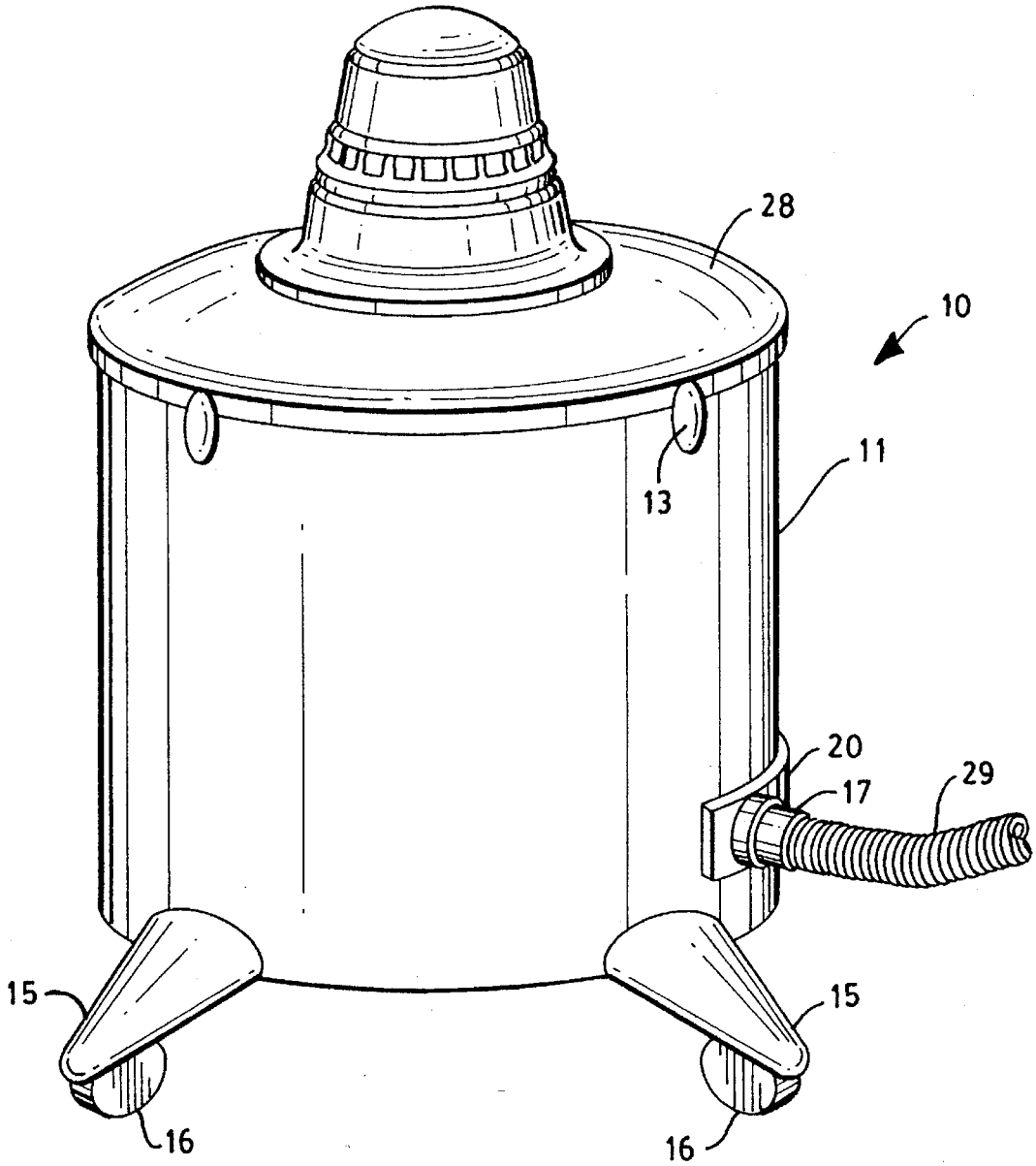
FIG. 5 is a perspective view of a vacuum cleaner assembly with low vacuum inlet.

FIG. 5 discloses a vacuum cleaner assembly generally designated as 28 having a tank 10, a plurality of caster mounts 15, a plurality of casters 16, a rolled upper edge 12, a plurality of releasable fasteners 13 connecting a cover 28 to tank 10. Cover 28 houses electric motor (not shown) and fan unit (not shown) and exhaust air outlet (not shown). Vacuum inlet 17 at base of tank 10 connects to flexible external vacuum hose 29.

Some variations and modifications of the structure herein disclosed will suggest themselves to those skilled in the art. Rigid molded annular tubing can be used rather than a flexible internal vacuum hose, so long as curves in the tubing remain fair. Flexible internal vacuum hose is used in the preferred embodiment because the nature of the material is such that it is disposed to select fair curves for itself and flexible hose is easy to install and easy to remove and to clear should debris clog the interior vacuum line. In the preferred embodiment the vacuum inlet passes through an annular opening in the vertical wall of the tank and liquid tight and air tight integrity around the vacuum inlet is achieved by sealing means. The vacuum inlet can be molded as a part of the tank wall with the molding itself being the sealing means. The vacuum inlet, if molded as a part of the tank, can be lowered so as to enter the tank partly in the base of the vertical wall and partly in the base of the tank, but with a minimal increased advantage in stabilizing the assembly when the assembly is towed. The internal conduit itself can be molded into and made a part of the tank itself but the vacuum inlet and internal conduit of the preferred embodiment recommends itself as requiring least sophisticated molding technique and maximum simplicity in manufacture and assembly.

Wet or dry shop vacuums now in the marketplace conduct debris and liquid waste up an external vacuum hose to a vacuum inlet in the cover of the assembly or high up on the side of the tank and then discharge debris and liquid waste down into the tank. In the disclosed invention, debris and liquid waste makes the same vertical ascent, but it does so through an internal vacuum hose within the tank thus making it possible to connect the external vacuum hose to a vacuum inlet located at the base of the tank The low connection point provides little leverage for pulling the assembly over when the operator pulls on the external vacuum hose and the casters encounter resistance on the surface being vacuumed.

The disclosed invention substantially enhances the vertical stability of wet or dry shop vacuums, including the shop vacuums having a high center of gravity. The disclosed invention provides maximum advantage when used in combination with the invention disclosed in my co-pending application "Wet or Dry Vacuum with Low Center of Gravity".

While other variations and modifications may suggest themselves, it is to be understood that the present disclosure relates to a preferred embodiment of the invention which is for purposes of illustration only and is not to be construed as a limitation of the invention. All such modifications which do not depart from the spirit of the invention are intended to be within the scope of the appended claims.

I claim:

1. An improved vacuum cleaner assembly of the type having a tank with a vertical wall and a base defining an accumulation area, a removable lid for sealing the tank, means for removably attaching the lid to the tank, means for evacuating air from the space within the tank, an outlet to exhaust air evacuated from the tank, movement means for providing mobility to the assembly, the improvement comprising:

a vacuum inlet suited to connection to an external vacuum hose introduced through the vertical wall of said tank at the base of said vertical wall;

a sealing means surrounding said vacuum inlet preserving liquid tight and air tight integrity of said vertical wall;

an internal conduit means connected to said vacuum inlet confining and directing the flow of matter passing through said vacuum inlet to the top of said tank and discharging said matter in a generally downward direction into the accumulation area of said tank;

whereby discharge of matter passing through the external vacuum hose, the vacuum inlet, and the internal conduit occurs high in the tank eliminating the problem of accumulated matter in the tank blocking the discharge of new matter entering the tank, and the connection of the external vacuum hose at the base of the tank produces insufficient mechanical advantage to enable the operator to capsize the vacuum cleaner assembly by pulling on the external vacuum hose.

2. The tank of claim 1 wherein said tank is comprised of molded plastic material.

3. The tank of claim 1 wherein said tank is of generally cylindrical shape with a plurality of caster mounts and casters attached to the bottom circumference of said tank.

4. The tank of claim 1 wherein said vacuum inlet is introduced through an annular opening at the base of said vertical wall of said tank.

5. The tank of claim 1 wherein said vertical wall of said tank is molded to an increased thickness for a predetermined distance surrounding said annular opening.

6. The tank of claim 1 wherein the cylindrical curve of said vertical wall is flattened for a predetermined distance surrounding said annular opening providing parallel flat surfaces surrounding said annular opening on both interior and exterior surfaces of said vertical wall.

7. The tank of claim 6 wherein the sealing means comprises male threads on the exterior surface of said vacuum inlet which cooperate with female threads of plastic nuts which compress resilient gaskets against the interior surface and the exterior surface of said vertical wall of said tank.

8. The internal conduit of claim 1 wherein said conduit is comprised of flexible vacuum hose molded to and an integral part of said vacuum inlet.

9. The internal conduit of claim 8 wherein said flexible vacuum hose rises in a fair curve from the vacuum inlet at the base of the tank to the top of the vertical wall of said tank where said flexible vacuum hose is clamped with discharge outlet facing generally downward and into the accumulation area of said tank.

10. An improved vacuum cleaner assembly of the type having a tank with a vertical wall and a base defining an accumulation area, a removable lid for sealing the tank, means for removably attaching the lid to the tank, means for evacuating air from the space within the tank, an outlet to exhaust air evacuated from the tank, movement means for providing mobility to the assembly, the improvement comprising:

a vacuum inlet suited to connection to a flexible external vacuum hose introduced through the vertical wall of the tank at the base of said vertical wall in a manner that preserves liquid tight and air tight integrity of said vertical wall surrounding entry of said vacuum inlet;

an internal conduit means connected to said vacuum inlet confining and directing the flow of matter passing through said vacuum inlet to the top of said tank and discharging said matter in a generally downward direction into the accumulation area of said tank;

whereby discharge of matter passing through the external vacuum hose, the vacuum inlet, and the internal conduit occurs high in the tank eliminating the problem of accumulated matter in the tank blocking the discharge of new matter entering the tank, and the connection of the external vacuum hose at the base of the tank produces insufficient mechanical advantage to enable the operator to capsize the vacuum cleaner assembly by pulling on the external vacuum hose.

* * * * *